US009650857B2

(12) United States Patent
Mailand et al.

(10) Patent No.: US 9,650,857 B2
(45) **Date of Patent: *May 16, 2017**

(54) METHOD OF SELECTIVE RELEASE OF AN OBJECT TO A SEAT ON A FRACK PLUG FROM IMMEDIATELY ADJACENT THE FRACK PLUG

(71) Applicant: Baker Hughes Incorporated, Houston, TX (US)

(72) Inventors: Jason C. Mailand, The Woodlands, TX (US); Daniel S. Matthews, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 352 days.

This patent is subject to a terminal disclaimer.

(21) Appl. No.: 14/203,072

(22) Filed: Mar. 10, 2014

(65) Prior Publication Data

US 2015/0252643 A1 Sep. 10, 2015

(51) Int. Cl.

| | |
|---|---|
| ***E21B 33/12*** | (2006.01) |
| ***E21B 23/08*** | (2006.01) |
| ***E21B 43/116*** | (2006.01) |
| ***E21B 43/119*** | (2006.01) |

(52) U.S. Cl.

CPC ..... *E21B 33/12* (2013.01); *E21B 23/08* (2013.01); *E21B 43/116* (2013.01); *E21B 43/119* (2013.01)

(58) Field of Classification Search

CPC ..... E21B 23/14; E21B 33/12; E21B 47/06; E21B 43/11; E21B 43/116; E21B 43/119

See application file for complete search history.

(56) References Cited

U.S. PATENT DOCUMENTS

| | | | | |
|---|---|---|---|---|
| 5,180,009 | A * | 1/1993 | Sneed | E21B 23/10 166/155 |
| 6,012,525 | A * | 1/2000 | Burleson | E21B 17/1014 166/297 |
| 7,273,096 | B2 * | 9/2007 | Den Boer | E21B 47/01 166/328 |
| 2013/0020065 | A1 | 1/2013 | Tubel et al. | |
| 2013/0024030 | A1 | 1/2013 | Tubel et al. | |
| 2013/0175053 | A1 | 7/2013 | Madero et al. | |
| 2015/0252642 | A1 * | 9/2015 | Mailand | E21B 23/14 166/250.01 |

* cited by examiner

*Primary Examiner* — Brad Harcourt

(74) *Attorney, Agent, or Firm* — Steven Rosenblatt

(57) ABSTRACT

In a fracking context the object that will ultimately block a passage in an isolation device is introduced into the zone with the bottom hole assembly. The object is not released until the guns fire to create a pressure spike in the borehole that triggers the object retaining device to release the object. The retaining device is placed in close proximity to the isolation device and its setting tool to allow a larger object and passage in the isolation device to be used. If the guns misfire, the object is not released and comes out with the guns. The replacement guns can be pumped in because the passage in the isolation device has stayed open during the misfire. Direct and indirect object release in response to pressure created from the firing of the guns is contemplated.

18 Claims, 20 Drawing Sheets

METHOD OF SELECTIVE RELEASE OF AN OBJECT TO A SEAT ON A FRACK PLUG FROM IMMEDIATELY ADJACENT THE FRACK PLUG

FIELD OF THE INVENTION

The field of the invention is plug and perforate methods of sequential zone fracturing and more particularly devices and methods that allow retrieval of a frack plug occluding object designed to selectively plug an isolation device in the event the guns misfire and new guns need to be run in after the original guns are removed.

BACKGROUND OF THE INVENTION

In typical plug and perforate systems the bottom hole assembly (BHA) comprises an isolation device with a passage through it and a surrounding seat on the passage for an object to land on the seat and obstruct the passage. The object can be delivered with the isolation device or pumped to the isolation device after the perforating guns are shot and removed from the borehole with the setting tool for the isolation device. Delivering the object with the isolation device has the advantage of saving time to get the passage in the isolation device closed as compared to pumping down an object from the surface. However, this prior method has a drawback if the guns misfire. In essence, if the guns misfire they must be removed and new guns run in to the desired location which is frequently in a horizontal portion of the wellbore. Thus, gravity is not much help in running in the replacement guns. Furthermore, if the object was run in with the isolation device, then the object would be forced against the seat in the passage of the isolation device if any effort to use pressure or flow to deliver the replacement guns was employed. The closing off of the passage in the isolation device means the replacement guns cannot be delivered on wireline with a pressure or flow assist and that alternative means such as coiled tubing or tractors have to be used to get the guns into position. This adds enormous expense to the operation and creates issues of delay. Even if the object is dropped after the misfired gun is removed, it still takes time to pump the object from the surface to the seat on the isolation device that is thousands of meters away costing time and additional fluid displacement.

In the past one way to cut the time to get an object seated on a seat in an isolation device was to include a ball release device above the guns. The idea in US 2013/0175053 was to release the object into the annulus from above the fired gun and have the object make its way around the fired gun and the isolation device setting tool to a seat on a passage in the isolation device. A physical pull on the wireline sheared an unnumbered pin and allowed a ball 24 to escape through a lateral opening 28 to make its way toward the isolation device 14. There are many issues with this design. Frequently the guns 18 have very low clearance around them to the casing 12, which means the ball 24 will not fit in the annular space or would have to be so small that the passage in the isolation device 14 would also have to be small. A smaller passage in the isolation device could mean delays if a replacement gun has to be delivered with flow after an original gun misfires. The spent perforating gun could also have burrs and sharp edges that could hang up or damage the object so badly that it might not seal at all when landing in the seat. Finally, in a horizontal run the object may not actually land on the seat if the seat surrounding the passage in the isolation device is considerably smaller than the casing inside diameter, a condition made necessary by the object being small enough to travel past the gun in the surrounding annulus around the gun.

Generally related to operation of lateral passages that can be selectively opened in a fracking context are US2013/0024030 and US2013/0020065.

What is needed is a device and method that allows retention of the object that is designed to go onto a seat for a passage in an isolation until such time as the gun actually fires. The reason is that if the guns misfire and need to be replaced, it will still be possible to deliver the replacement guns with pressure or flow because the passage in the isolation device will be open because the object has been retrieved with the misfired guns. What is also provided is a launcher for the object that is placed in close proximity of the isolation device which allows the use of a larger object than when the launcher is above the guns and has to deliver the object into an annulus between the gun and the casing after the gun fires. What is also provided is an object launching device that responds directly or indirectly to the concussive pressure shock created by the guns initially firing so that the object is only released if the guns actually fire. This allows for the object to be retrieved without release if the guns misfire so that the replacement guns can be delivered with flow through the still open passage in the isolation device. On the other hand, if the guns fire then the pressure that is built up from the firing will release the object allowing the start of fracturing after the guns and setting tool for the isolation device are pulled out. Those skilled in the art will further appreciate additional aspects of the invention from a review of the description of the preferred embodiment and the associated drawings while recognizing that the full scope of the invention is to be determined by the appended claims.

SUMMARY OF THE INVENTION

In a fracking context the object that will ultimately block a passage in an isolation device is introduced into the zone with the bottom hole assembly. The object is not released until the guns fire to create a pressure spike in the borehole that triggers the object retaining device to release the object. The retaining device is placed in close proximity to the isolation device and its setting tool to allow a larger object and passage in the isolation device to be used. If the guns misfire, the object is not released and comes out with the guns. The replacement guns can be pumped in because the passage in the isolation device has stayed open during the misfire. Direct and indirect object release in response to pressure created from the firing of the guns is contemplated.

DETAILED DESCRIPTION OF THE PREFERRED EMBODIMENT

Figure 1:
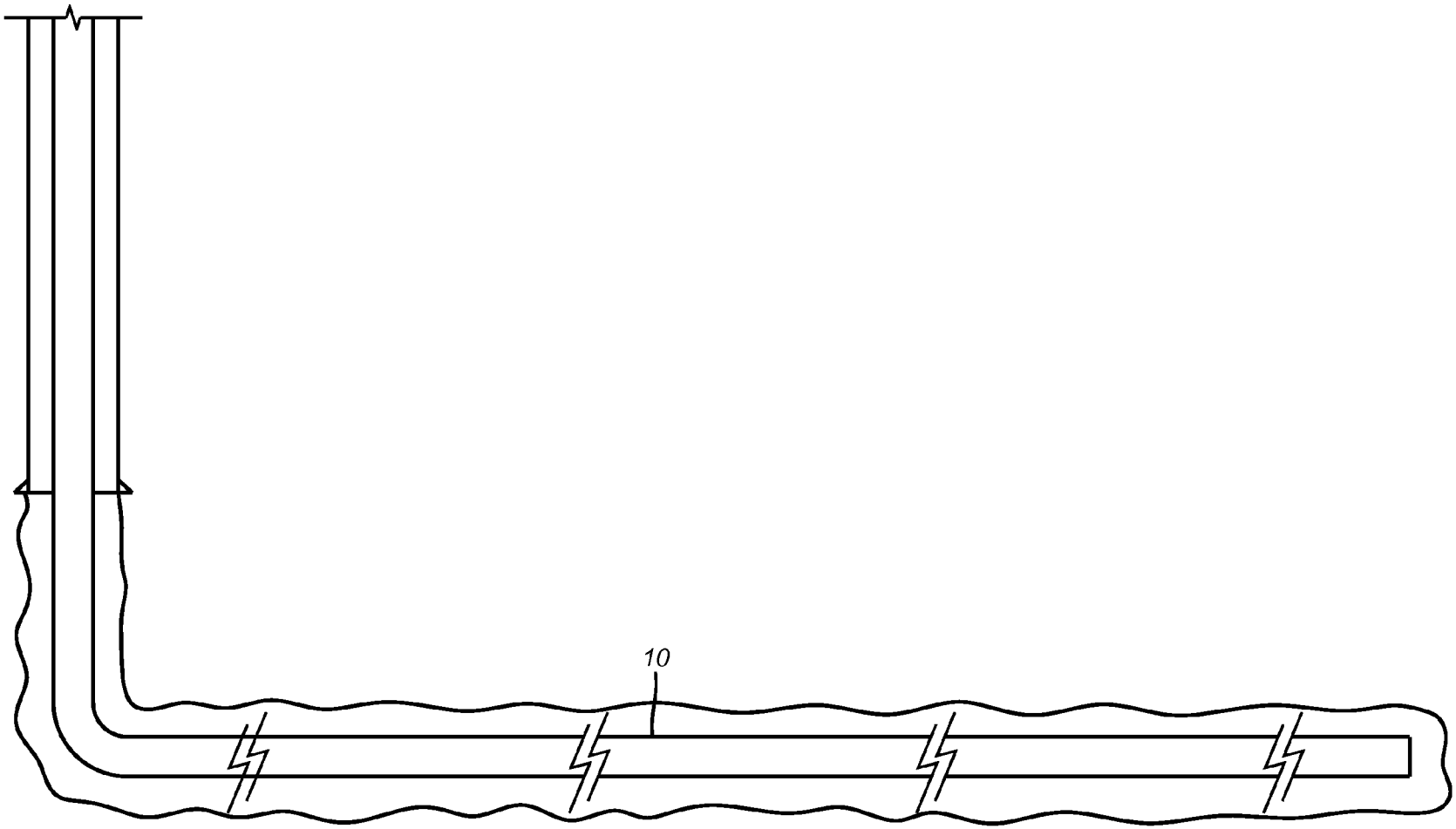
(PRIOR ART) FIG. 1
FIG. 1 is a prior art section view of a cemented production tubing in a horizontal portion of a borehole.
Figure 2:
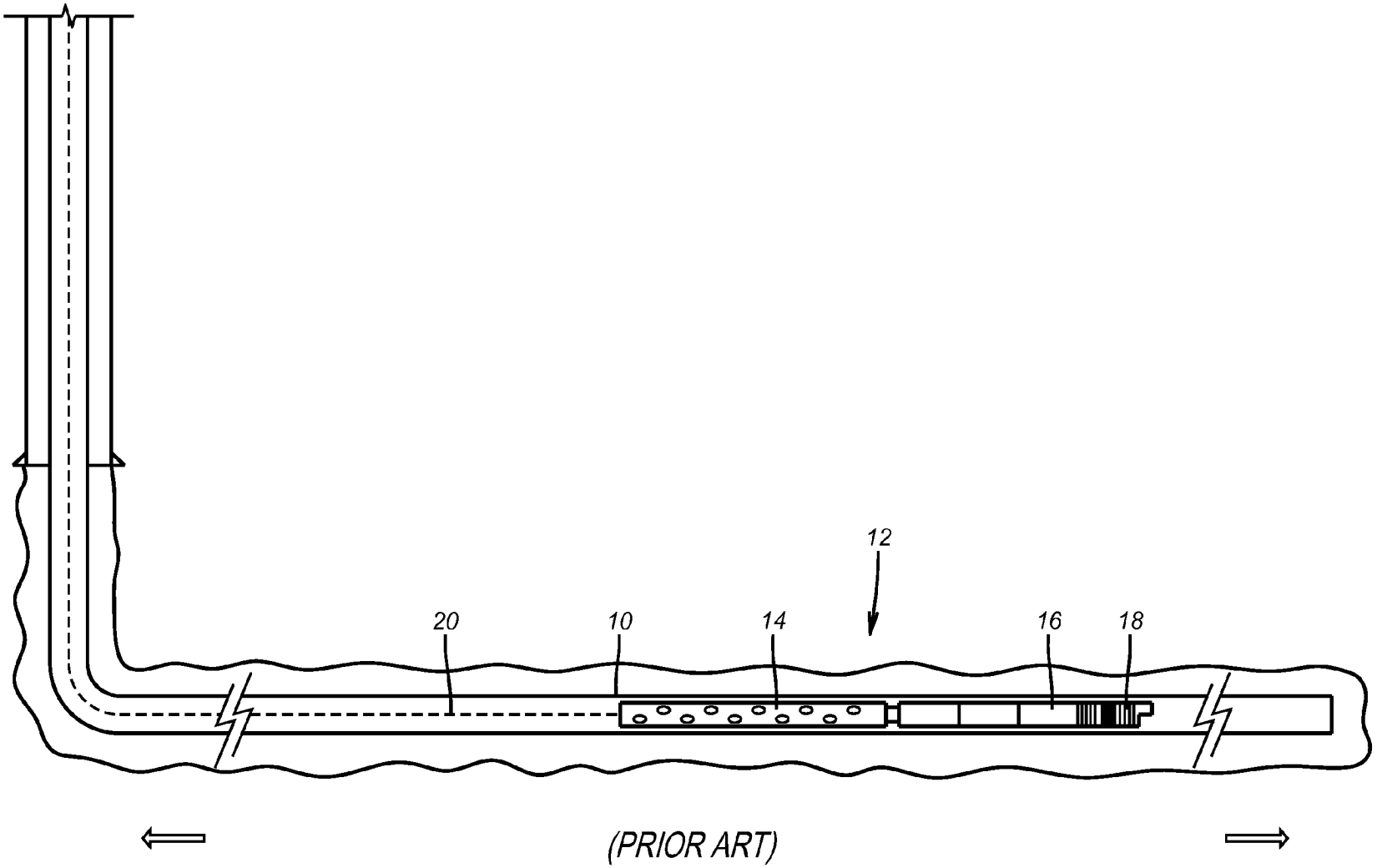
(PRIOR ART) FIG. 2
FIG. 2 is the view of FIG. 1 showing the bottom hole assembly in position.
Figure 3:
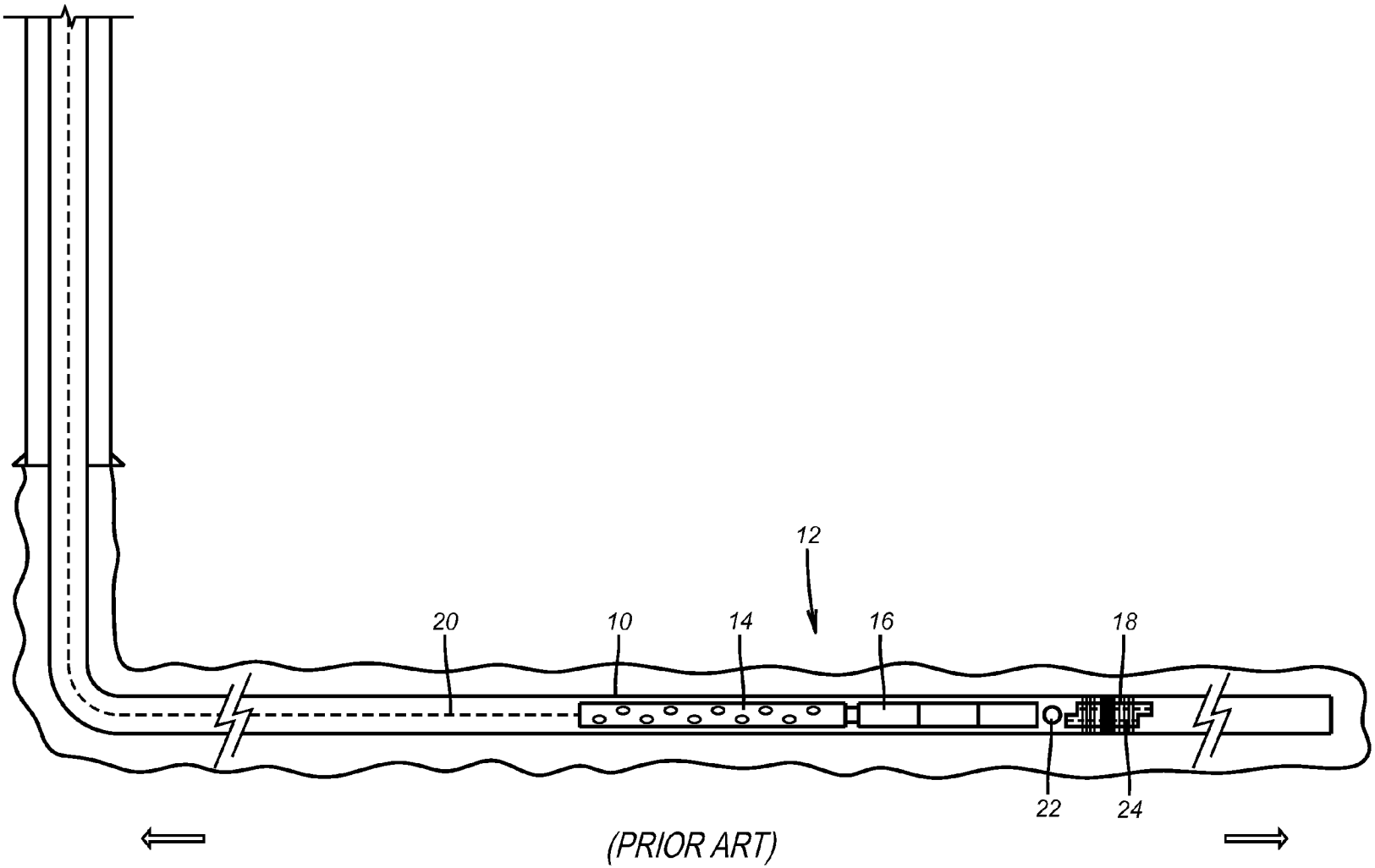
(PRIOR ART) FIG. 3
FIG. 3 is the view of FIG. 2 with the frack plug set and the guns separated from the set plug while the ball for the plug is also released and floating.
Figure 4:
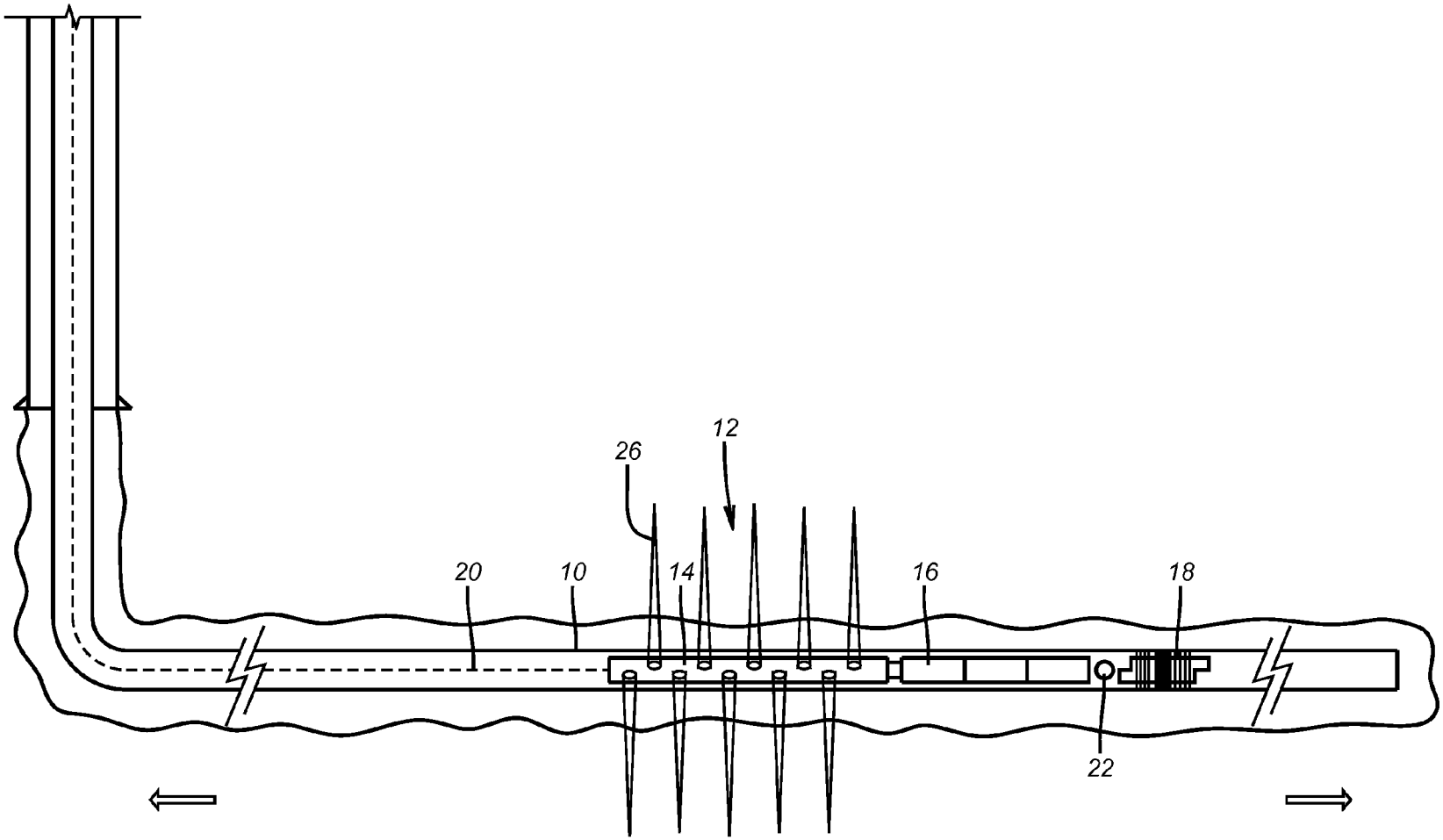
(PRIOR ART) FIG. 4
FIG. 4 is the view of FIG. 3 shows the guns being fired.
Figure 5:
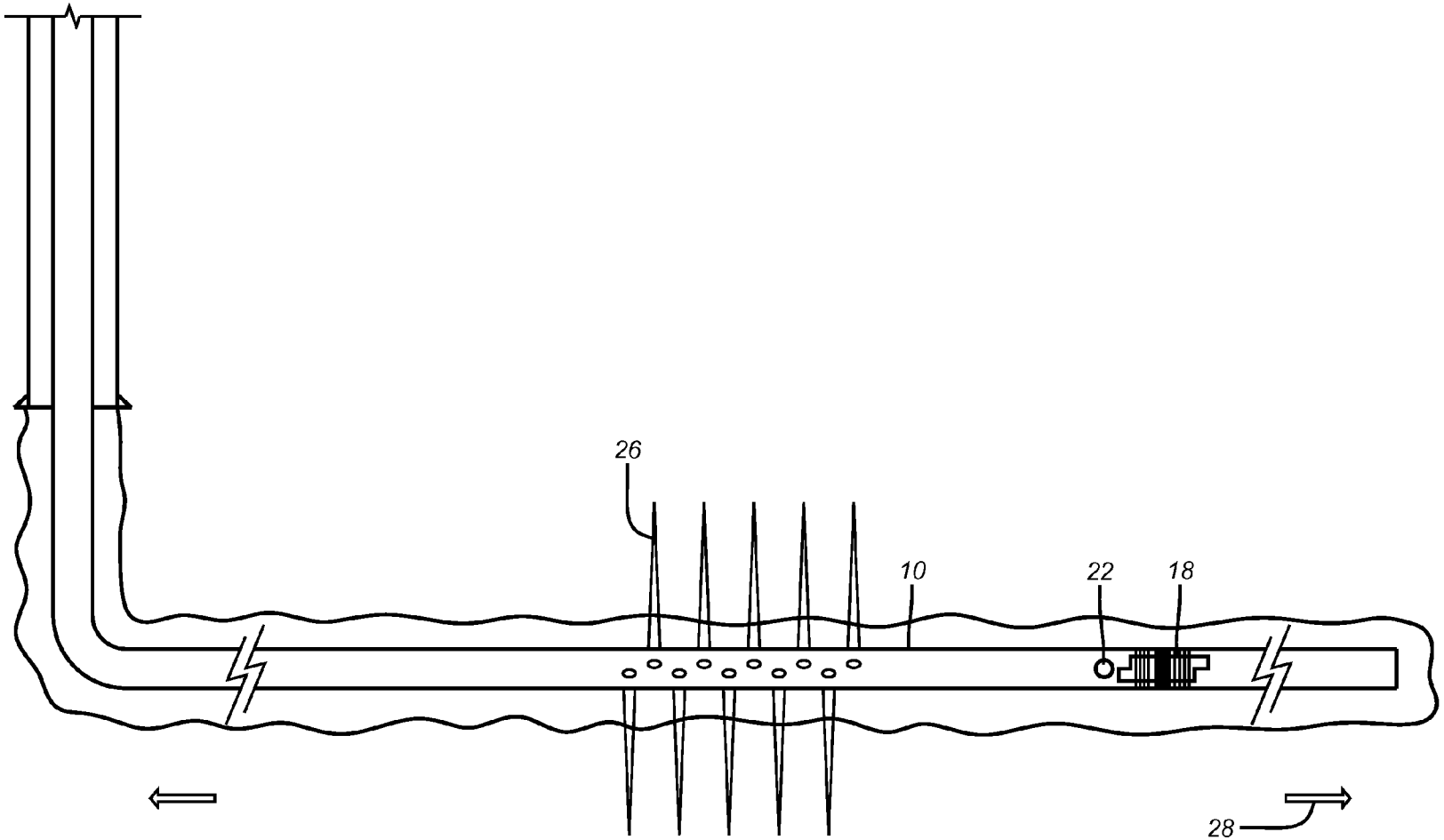
(PRIOR ART) FIG. 5
FIG. 5 is the view of FIG. 4 showing the BHA removed.
Figure 6:
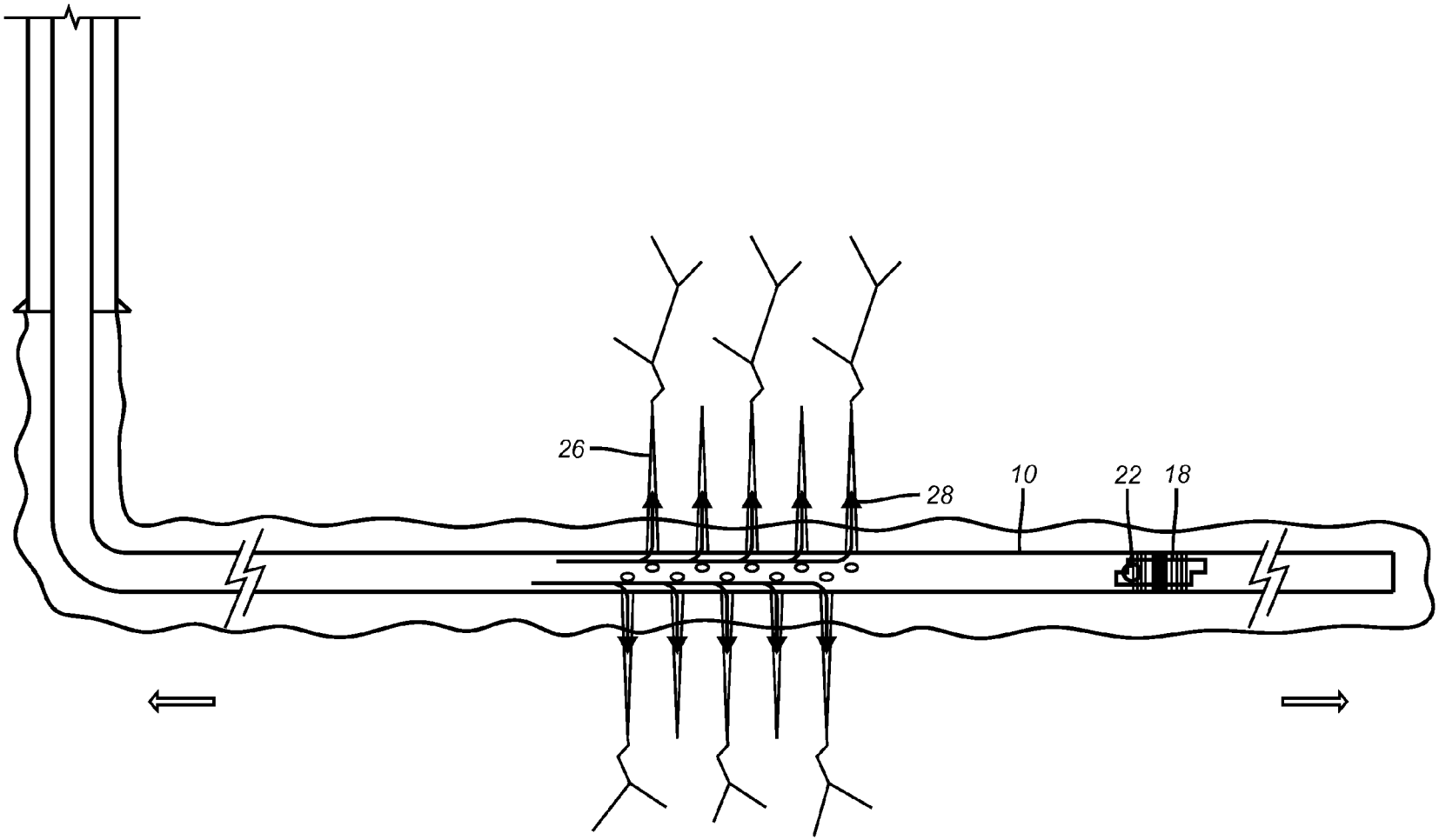
(PRIOR ART) FIG. 6
FIG. 6 is the view of FIG. 5 showing the ball seated in the frack plug as pressure is built up to fracture the perforations created by the guns.

FIGS. 1-6 illustrate a known way of doing a plug and perforate fracturing technique in a horizontal cemented production casing 10. FIG. 2 shows the BHA 12 in the desired location of the casing 10. The BHA 12 comprises perforating guns 14 followed by a setting tool 16 and a frack plug 18. The BHA 12 is run in on wireline 20. In FIG. 3 the setting tool 16 has set the frack plug 18 and released from the frack plug 18 so that the frack ball 22 is released. The wireline 20 provides power to the setting tool 16 which can be an E-4 setting tool sold by Baker Hughes Incorporated. The BHA 12 that is suspended by wireline 20 is aided in travelling into the horizontal portion of the well by pressure from the surface that creates flow to carry the BHA 12 into the horizontal portion of the borehole. At this time the frack plug is unset and flow can get past it and into an already perforated zone that is lower or into the formation if it is the initial zone to be perforated. The frack plug 18 has a through passage and surrounding ball seat 24 on which ball 22 lands to close the passage when there is flow urging the ball 22 toward the seat around passage 24. FIG. 4 shows the guns 14 being fired to create the perforations 26. FIG. 5 shows the BHA 12 removed from the casing 10. Note that the ball 22 is still floating because there is no applied pressure from the surface that creates flow in the direction of arrow 28. In FIG. 6 the pressure represented by arrows 28 is applied that forces ball 22 against the ball seat on passage 24 so that pressure is built up onto the perforations 26 to frack them.

Figure 7:
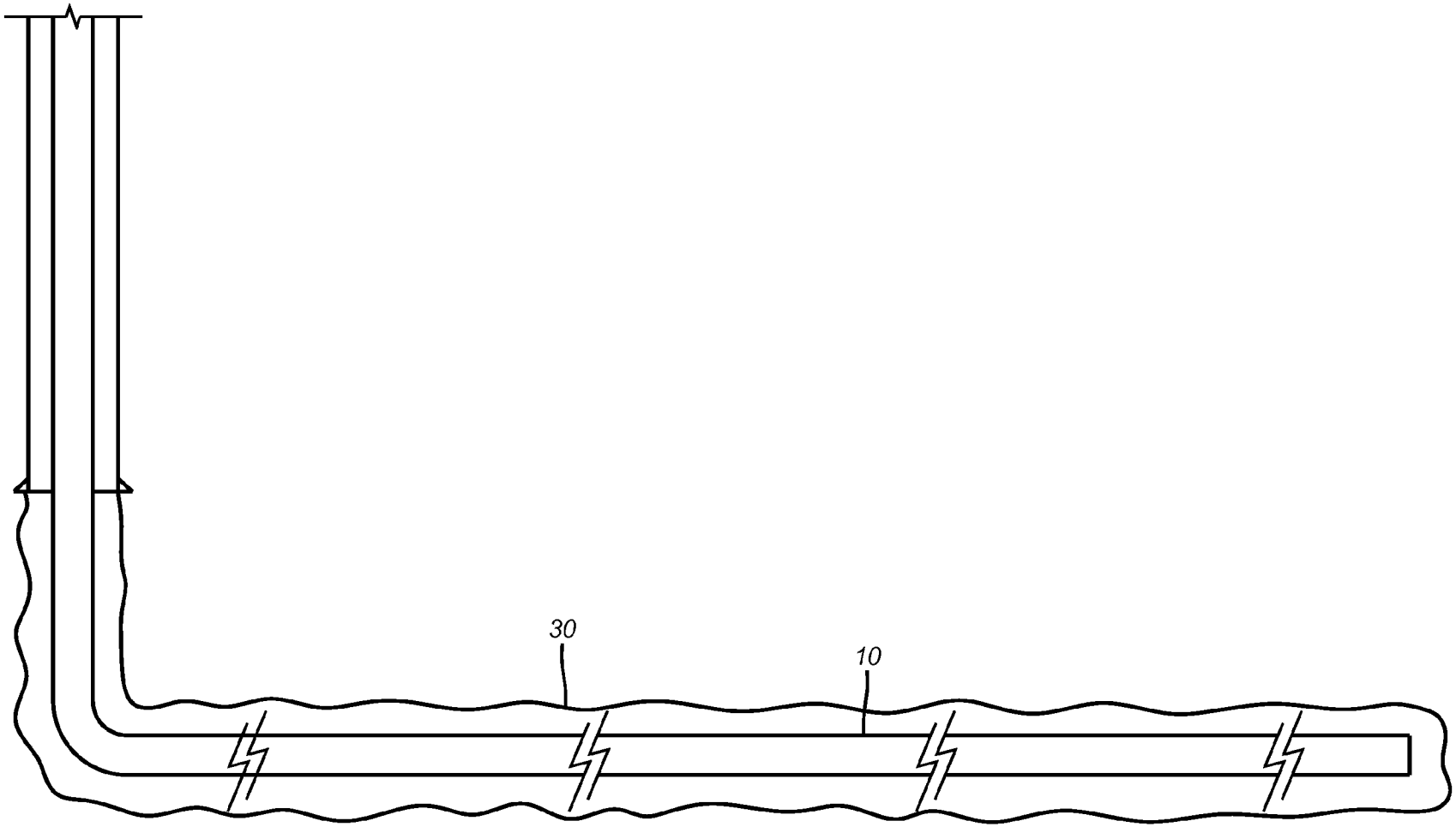
(PRIOR ART) FIG. 7
FIG. 7 is a prior art view of a horizontal portion of a borehole with cemented casing to illustrate the problem of gun misfire.
Figure 8:
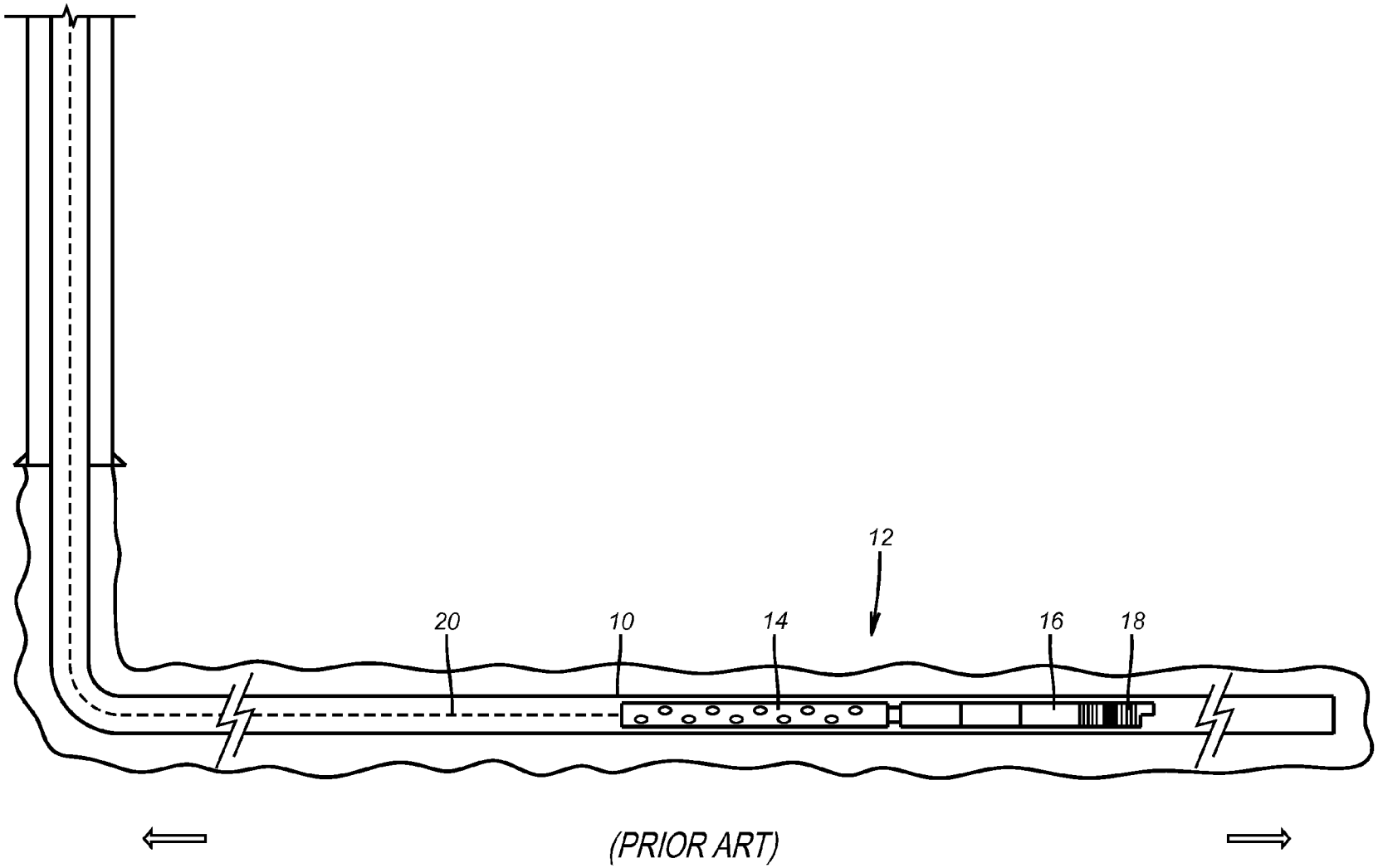
(PRIOR ART) FIG. 8
FIG. 8 is the view of FIG. 7 showing the BHA run into position.
Figure 9:
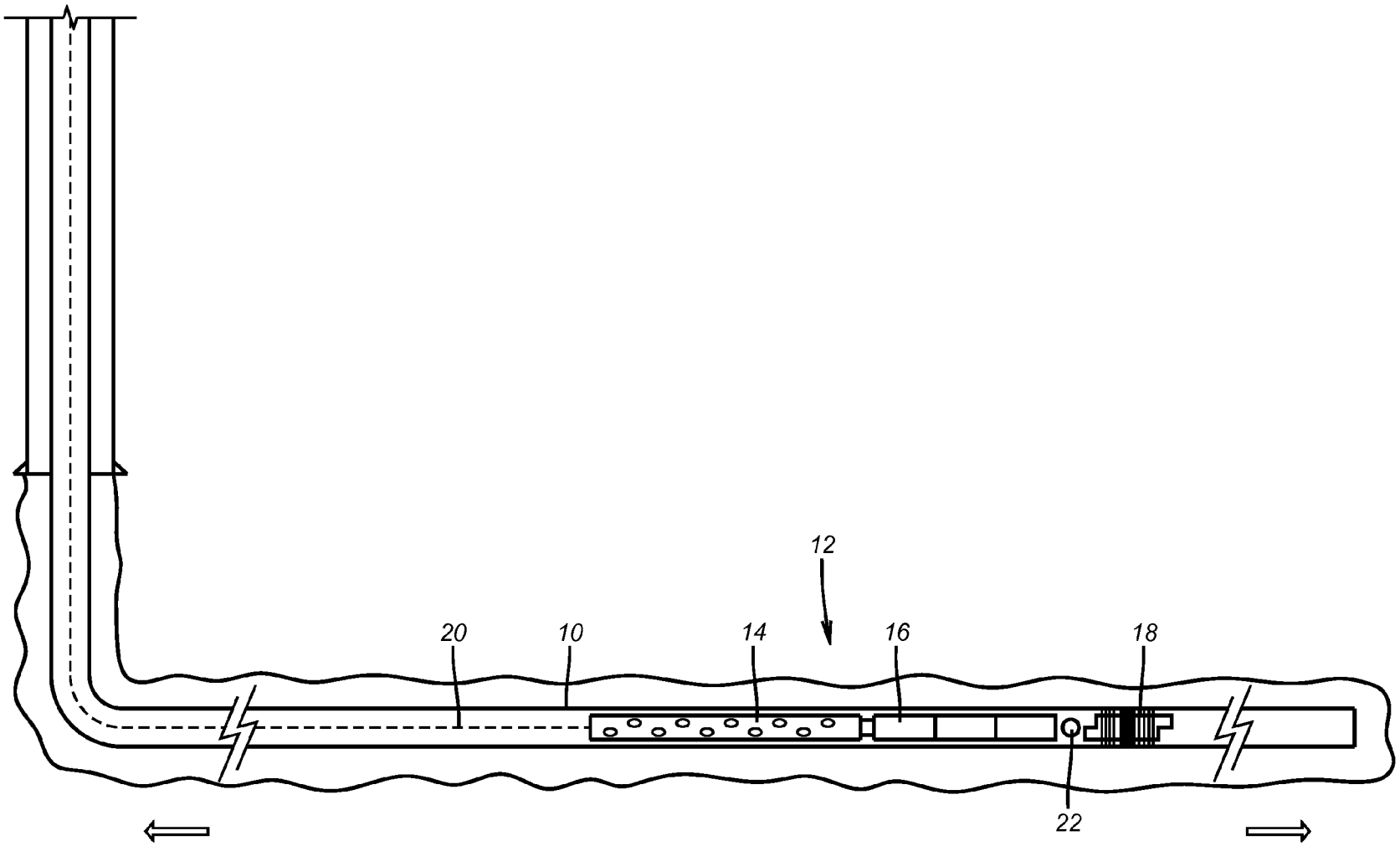
(PRIOR ART) FIG. 9
FIG. 9 is the view of FIG. 8 showing the frack plug set and the frack ball released.
Figure 10:
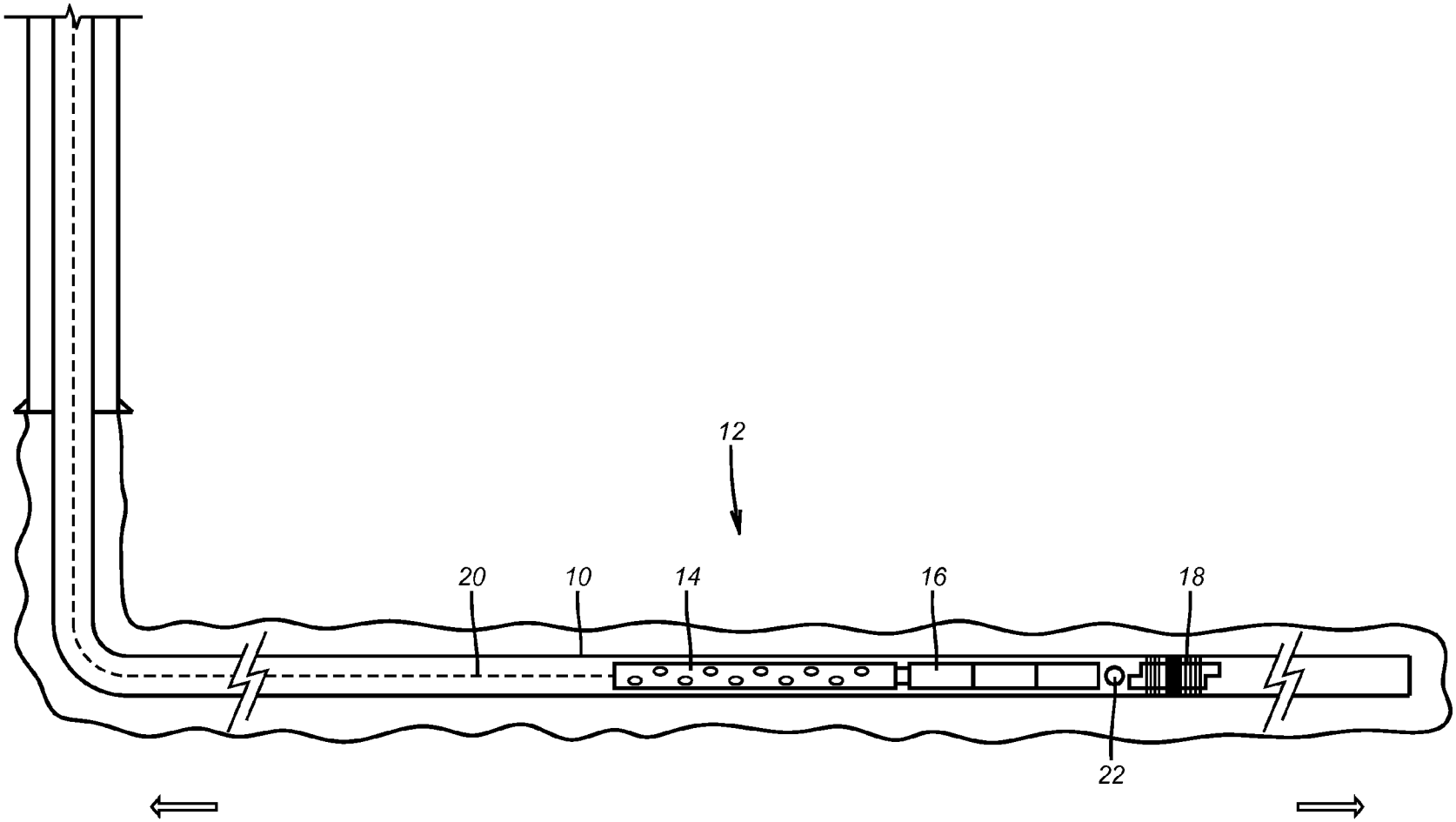
(PRIOR ART) FIG. 10
FIG. 10 is the view of FIG. 9 showing the guns having misfired.
Figure 11:
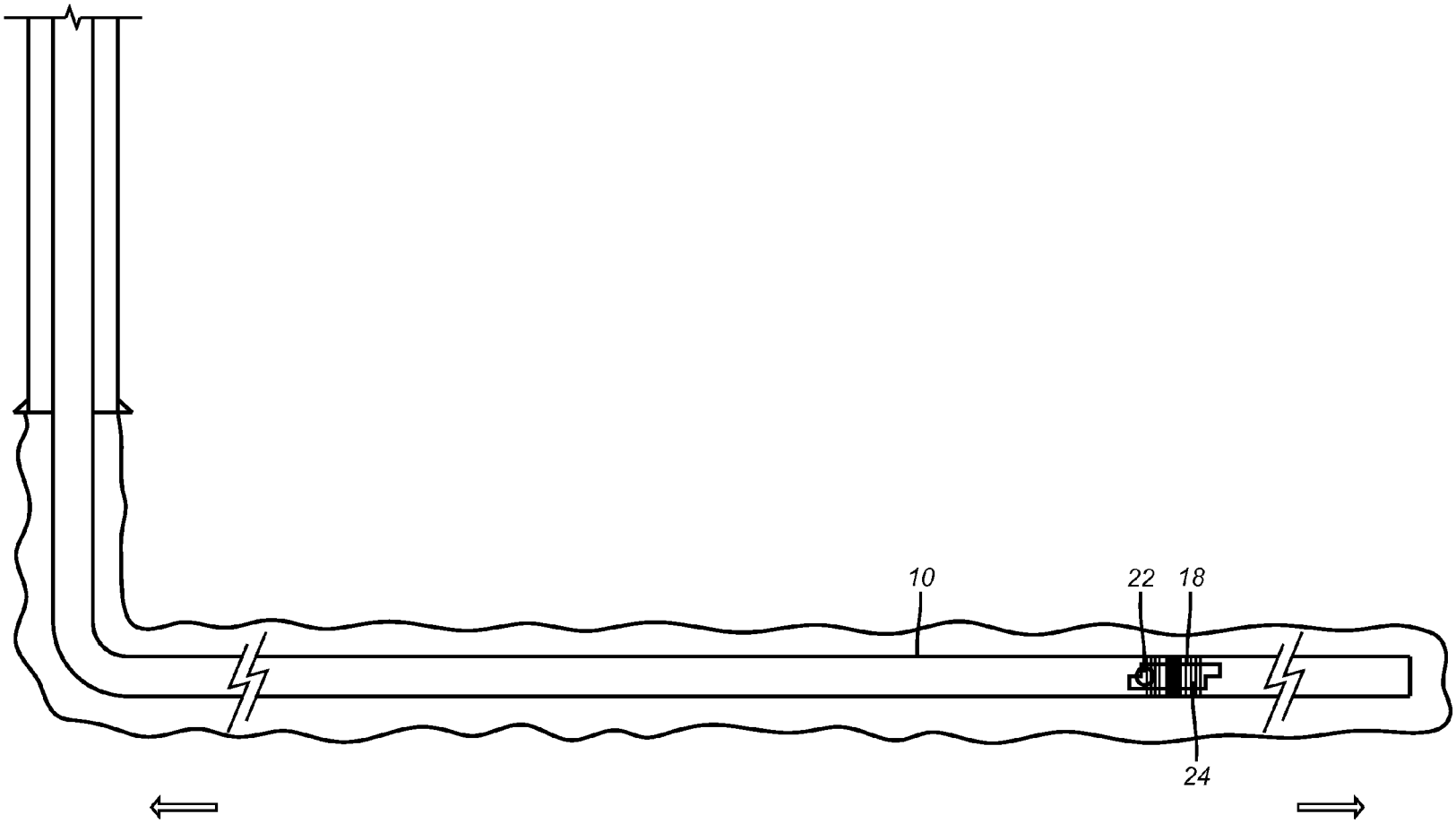
(PRIOR ART) FIG. 11
FIG. 11 is the view of FIG. 10 with the BHA removed and the frack ball on the seat of the frack plug preventing a replacement gun from being delivered on wireline with a pressure assist.

The sequence of FIGS. 7-11 represent an illustration of what can go wrong if the guns 14 misfire. FIG. 7 is the same as FIG. 1 showing the cemented casing 10 in a horizontal portion of the well 30. The same BHA 12 is run in as in FIG. 2 as is shown in FIG. 8. The frack plug 18 is set in FIG. 9 and an attempt to fire the guns 14 after a release of the setting tool 16 from the plug 18 results in a misfire of the guns. However, the ball 22 is released in this separation process between the setting tool 16 and the frack plug 18. The problem now created when the BHA 12 is pulled out is evident by looking at FIG. 11. There is a need to run in a replacement BHA 12' into the position formerly occupied by the original BHA 12 that had the guns 14 that misfired. The problem is that the ball 22 is blocking the passage 24 by sitting on the associated seat if there is any pressure applied in the casing 10. With the misfire there are no perforations 26 and the zone below is effectively isolated by the frack plug 18. What this means is that it will not be possible to use pressure that creates a flow to carry the BHA 12' into the lateral or horizontal portion 30. This means that the alternative is to deliver the BHA 12' with coiled tubing or a tractor (not shown). Delivering the BHA 12' using either of these techniques is slow and therefore expensive. In the case of coiled tubing, there may also be issues of space for the coiled tubing unit at the wellsite particularly in offshore applications. Tractors are far slower than a delivery on wireline with a flow assist. A flow assist is not possible in an unperforated section of a casing that has a frack plug 18 in a set position with a ball 22 landed on the seat surrounding its passage 24.

Figure 12:
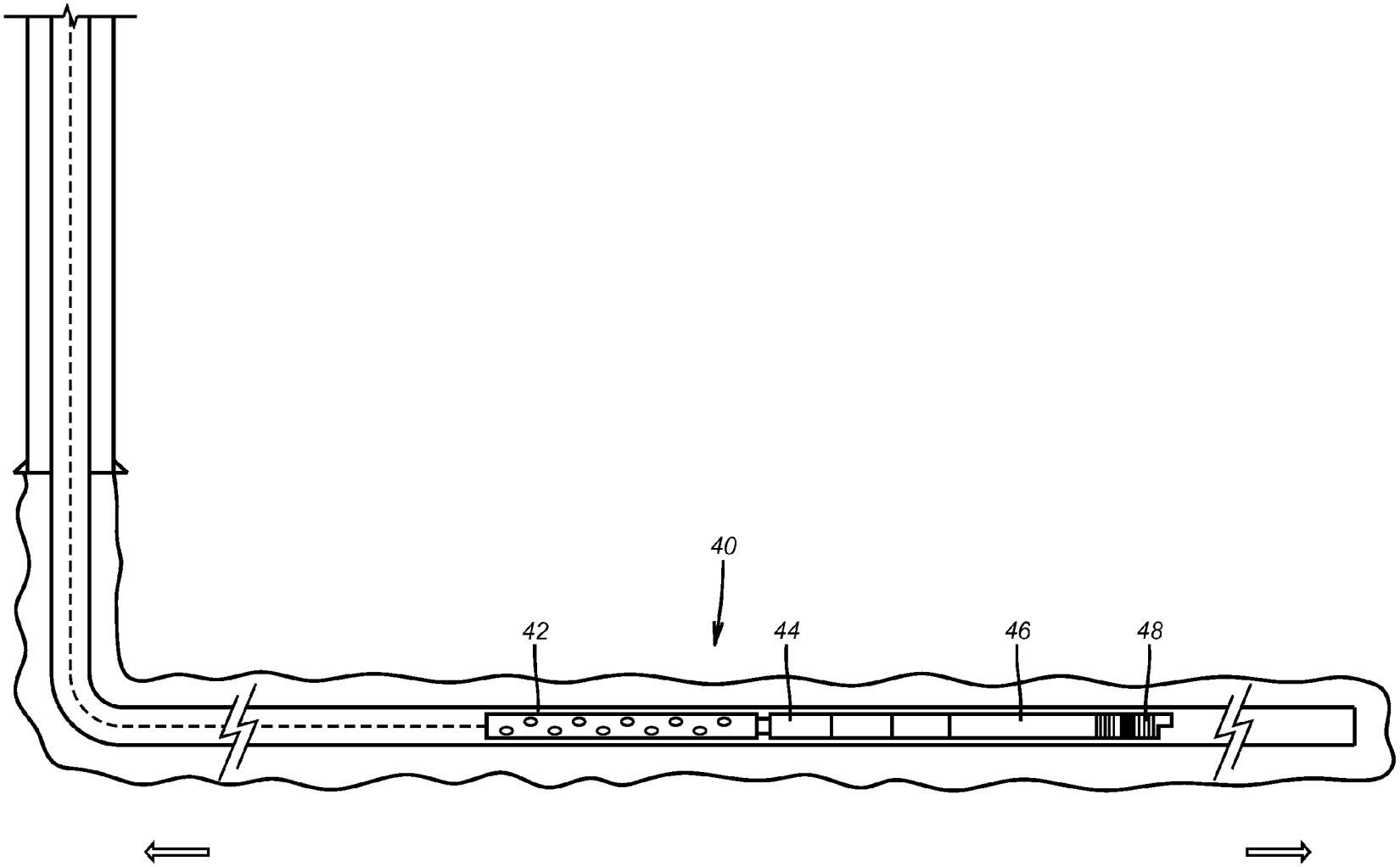
FIG. 12 shows the present invention with the BHA in position and the ball release tool between the setting tool and the frack plug.
Figure 13:
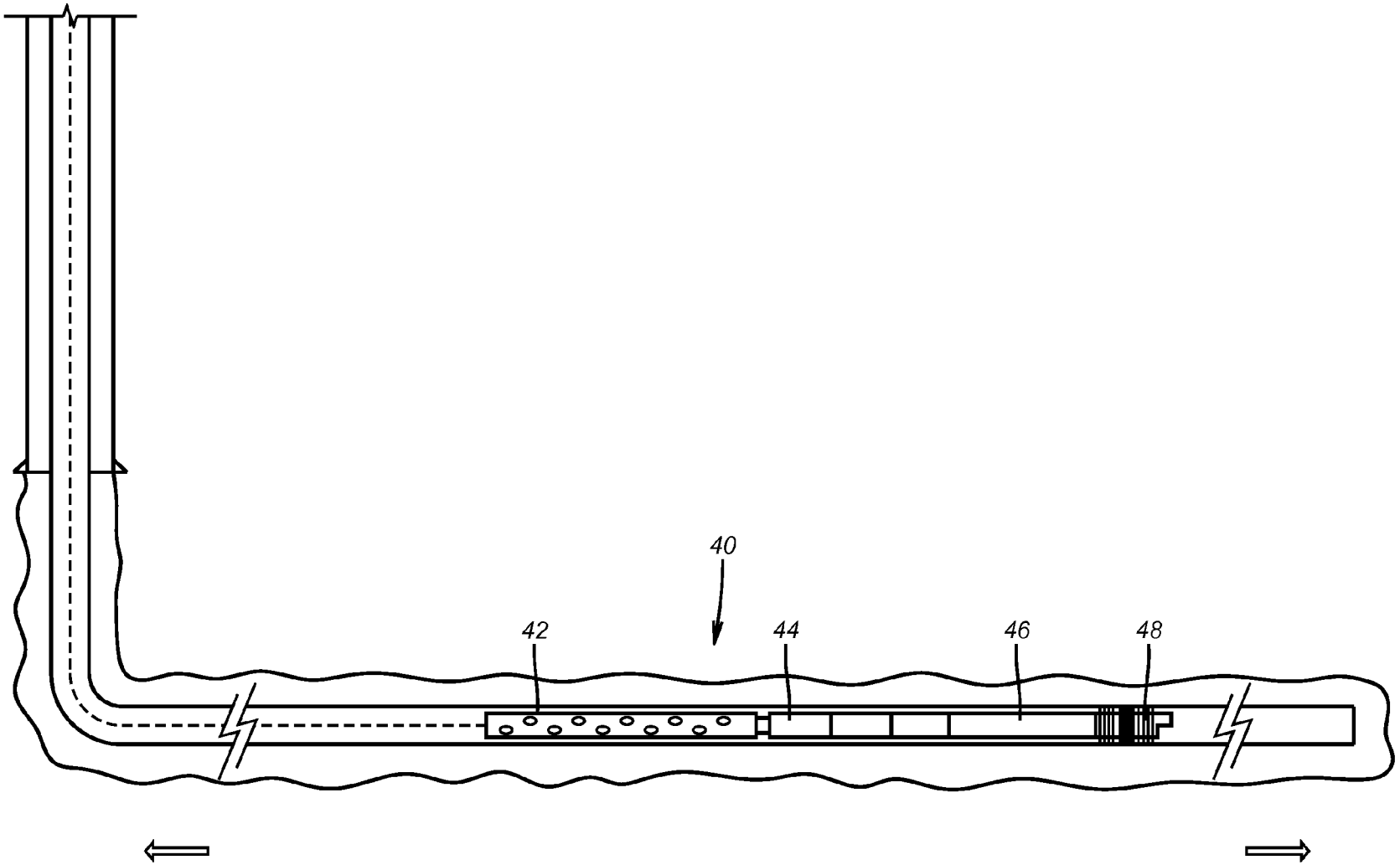
FIG. 13 is the view of FIG. 12 with the frack plug set.
Figure 14:
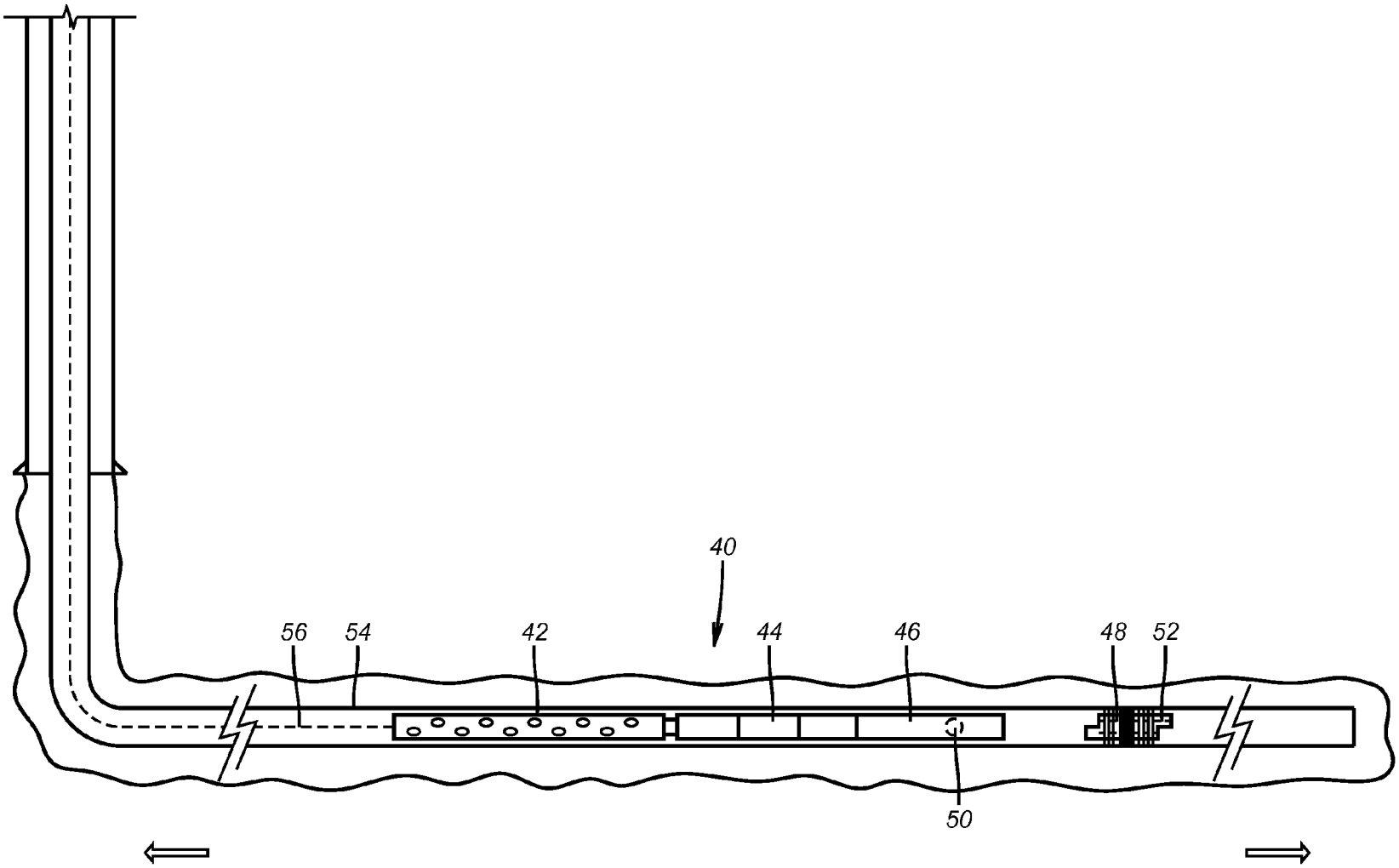
FIG. 14 is the view of FIG. 13 with the guns being pulled after a misfire with the frack ball still in the release tool.

With the above as a background, the present invention will be described in greater detail starting with FIG. 12 where the BHA 40 that comprises perforating guns 42, a plug setting tool 44 and a ball release tool 46 are disposed above the frack plug 48. In FIG. 13 the frack plug 48 is set as before. In FIG. 14 the release tool separates from the frack plug 48 while still retaining the frack ball 50. If the guns 42 misfire at this point then the frack plug 48 has a clear through passage 52 because the ball 50 has not obstructed it. The BHA 40 with the ball 50 can be pulled from the casing 54 with wireline 56.

Figure 15:
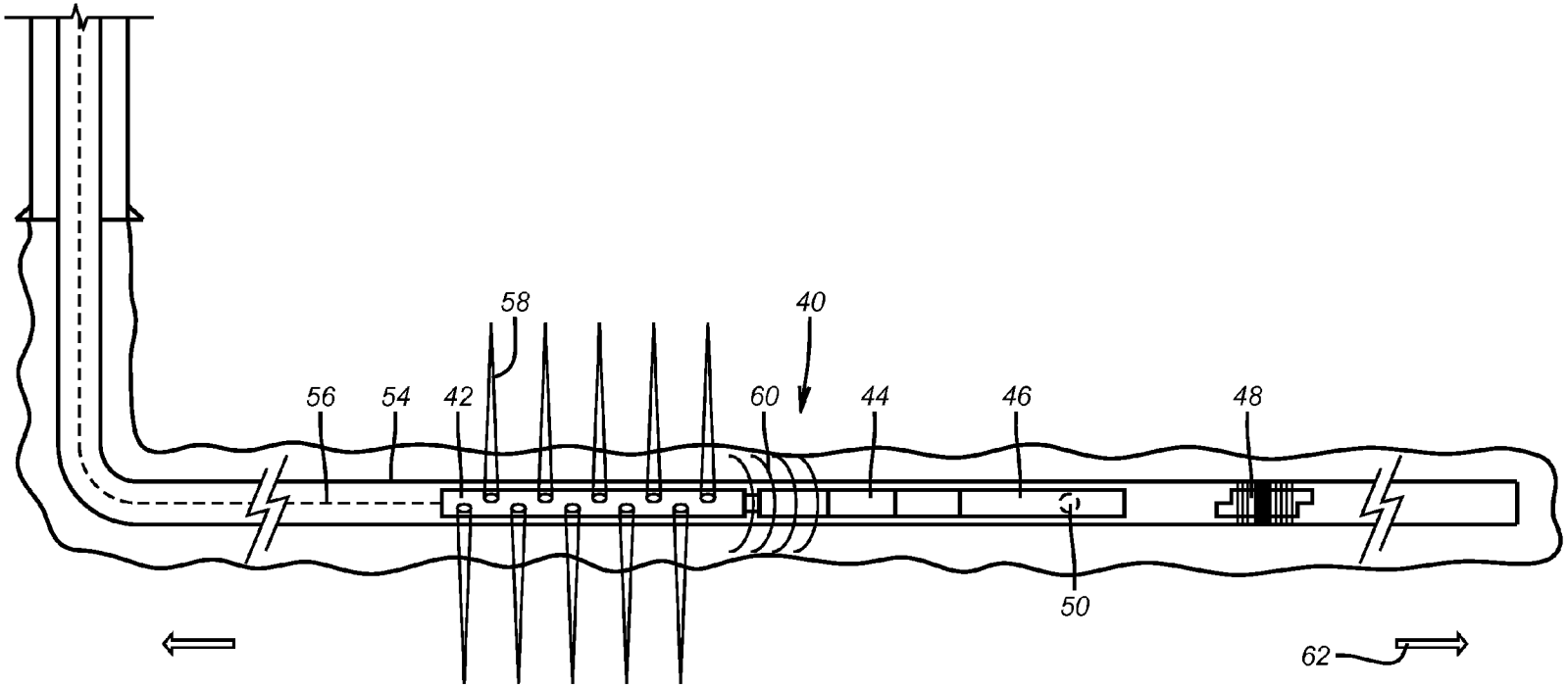
FIG. 15 is the view of FIG. 14 with the substituted guns in the hole and where the shock wave from firing is starting to migrate from the guns.
Figure 16:
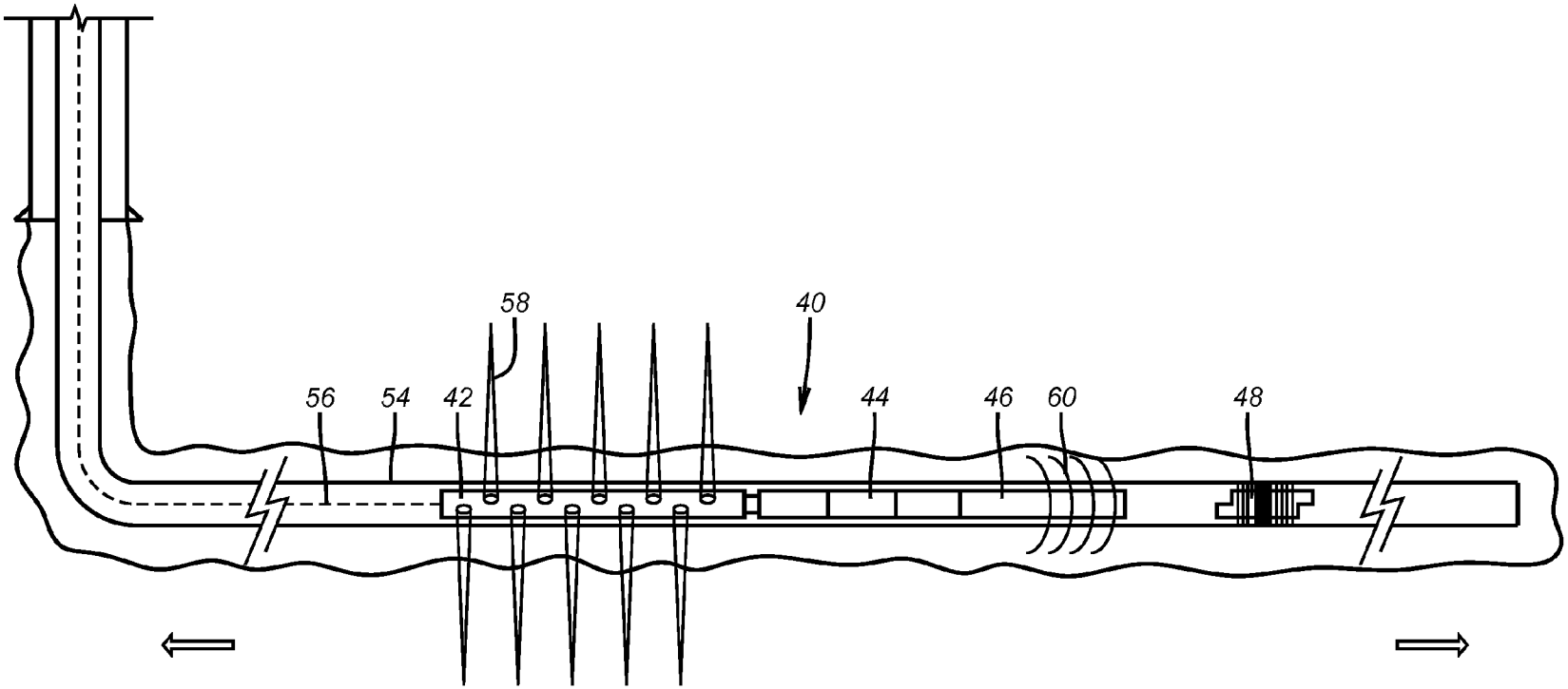
FIG. 16 is the view of FIG. 15 with the shock wave migrating to the release tool for a ball release.
Figure 17:
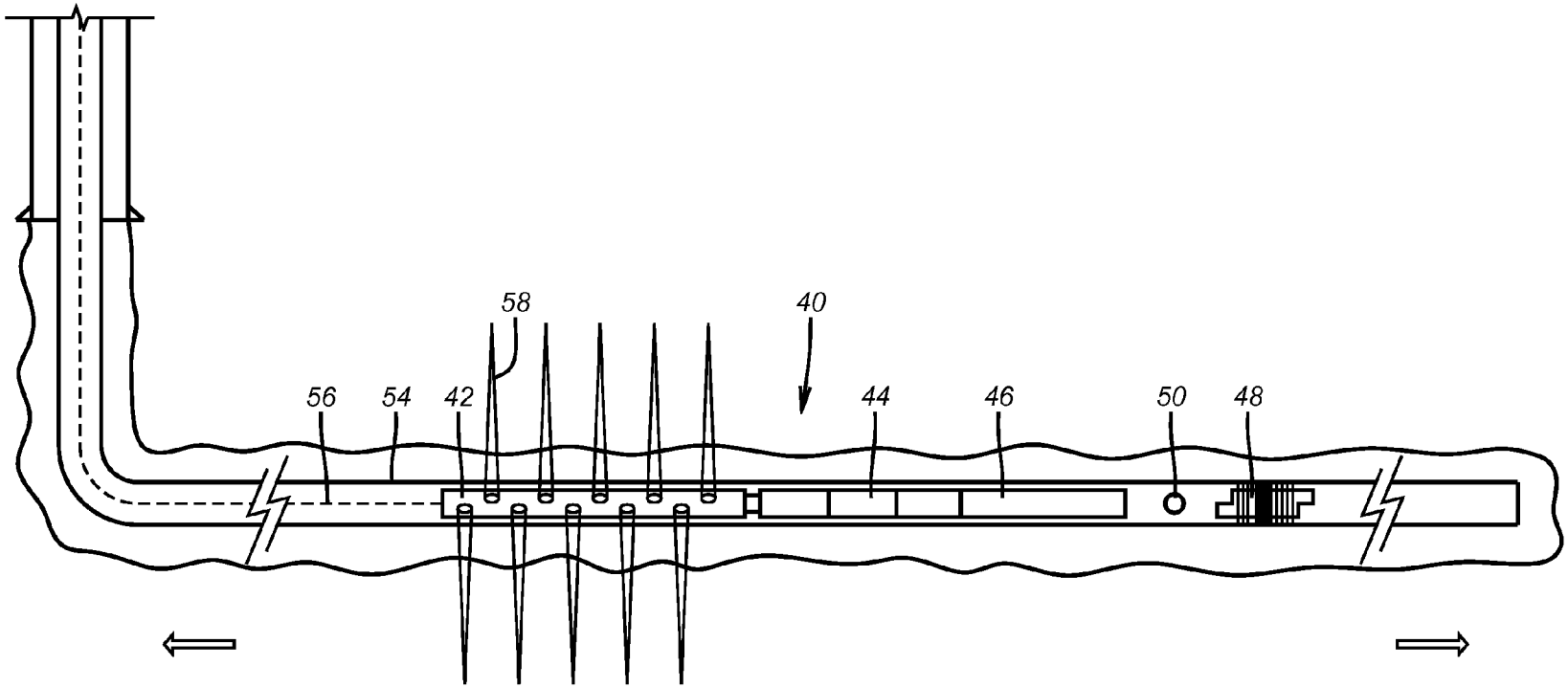
FIG. 17 is the view of FIG. 16 with the guns fired and the ball released from the ball release tool.
Figure 18:
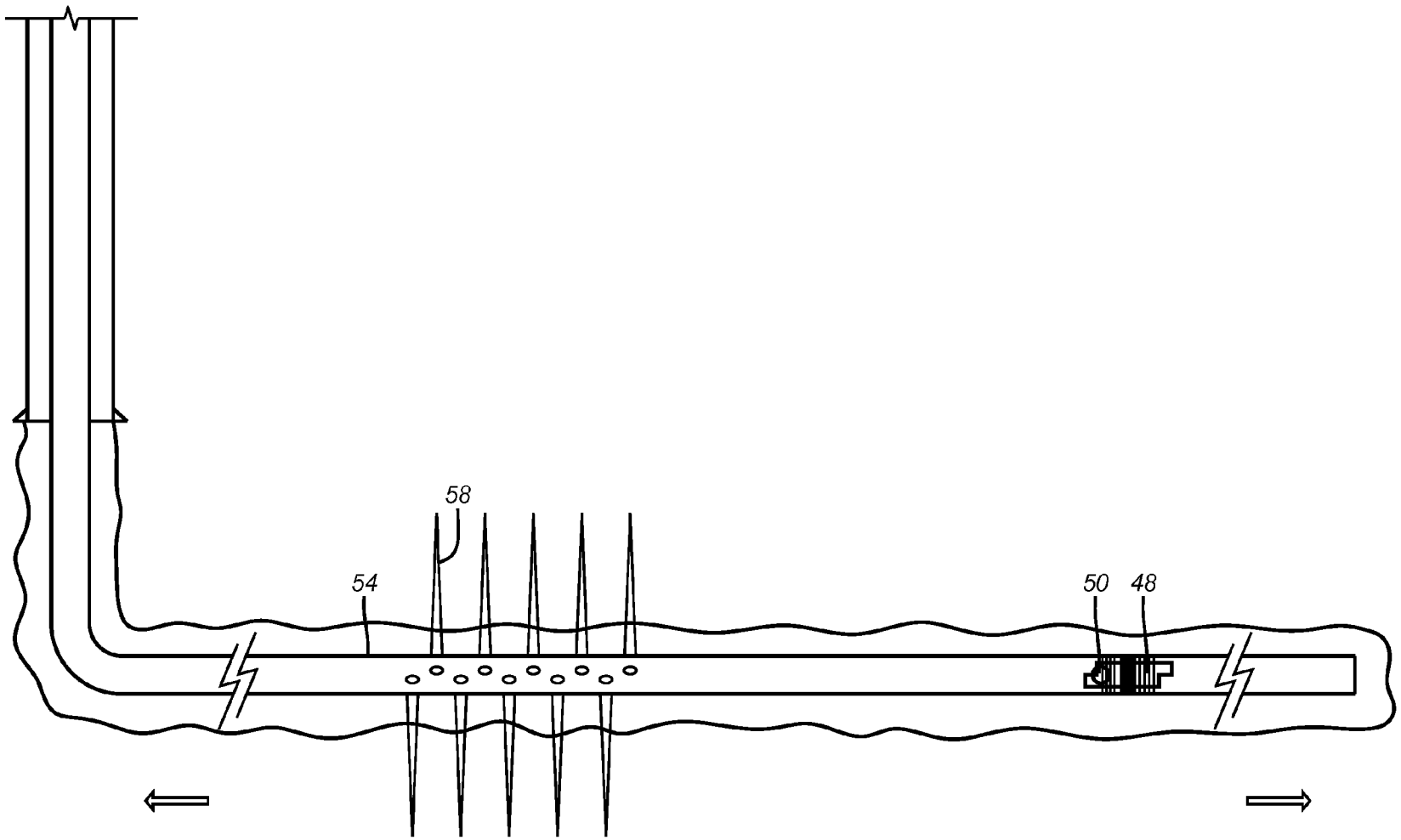
FIG. 18 is the view of FIG. 17 showing the BHA removed.
Figure 19:
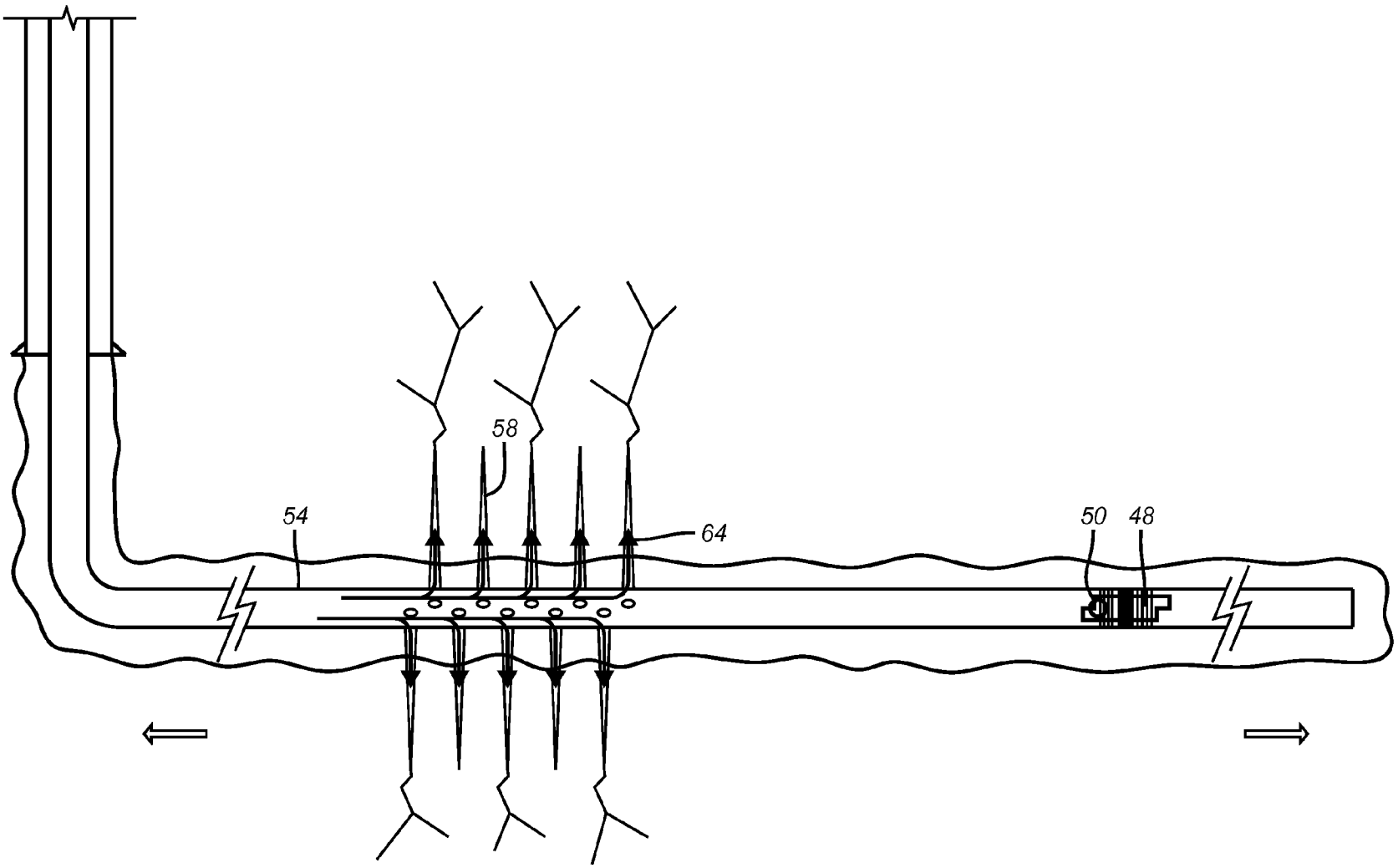
FIG. 19 is the view of FIG. 18 showing fracking with the plug ball on the seat of the frack plug.

On the other hand if the guns fire as shown in FIG. 15 then the perforations 58 are made. The operation of the guns creates a pressure wave 60 that migrates in the direction of arrow 62 toward the ball release tool 46 that is disposed between the setting tool 44 and the frack plug 48. FIG. 16 shows the pressure wave 60 reaching the ball releasing tool 46 so that the ball 50 is released from the release tool 46. Preferably the ball 50 is in alignment with the passage 52 in the frack plug 48 to facilitate seating the ball on a seat that surrounds the passage 52. This is shown in FIG. 17. The BHA 40 is now removed as shown in FIG. 18 and the perforations 58 are fracked as represented by pressure arrows 64.

Thus one aspect of the present invention is a method that allows retention of an object that can be a ball or plug or other shape that is designed to land in the passage of a frack plug, in the event the guns do not fire, and despite the fact that portions of the BHA have released from the frack plug 48 when that plug was set by the setting tool 44. The release of the frack ball 50 is dependent on the guns firing to create a signal that allows the ball release tool 46 to release the ball 50. Thus if the guns fire there is no problem in releasing the ball because there will be a flow path to allow a replacement gun to be wireline delivered with a flow assist. The gun can have multiple stages that sequentially fire so it possible to get one or more but not all stages to fire. In that event the gun has to be pulled and a new gun or the same gun redressed have to be run in later. In either case the method allows the completion process to continue. A misfire on the initial stage firing will not result in a ball release so that the next gun can be delivered on wireline with a flow assist with flow going through the frack plug that has an open passage. If at least one stage fires the ball is released but a subsequent gun can still be delivered on a wireline with a flow assist because the stage that did fire creates a fluid path for the flow assist to move the replacement gun into position.

In another aspect of the invention the placement of the ball release tool 46 immediately adjacent the frack plug 48 allows the use of a larger passage 52 through the frack plug 48 as well as a larger associated ball, or plug or dart 50. This is because unlike Madero US 2013/0175053 the ball does not need to travel in an annular space past the guns. The ball 50 is delivered below the guns 42 so it can be larger than a ball that has to travel in an annular gap which can be very small. The ability to use a larger passage in the frack plug 48 also speeds the delivery of a replacement gun if the original gun misfires because there is less pressure drop for the flow going through the passage of the frack plug 48 when the replacement gun is delivered. The release tool 46 can be up against the frack plug 48 or spaced from frack plug 48 with no intervening equipment in between. Alternatively, the ball can drop through another tool disposed between the release tool 46 and the frack plug 48.

Figure 15A:
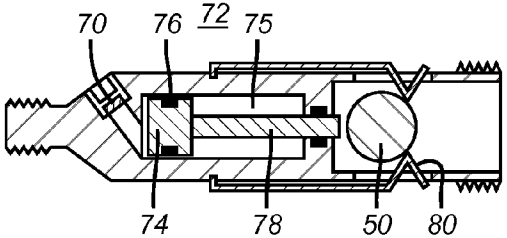
FIG. 15*a* is a detailed view of the ball releasing tool in a direct pressure actuated embodiment.
Figure 16A:
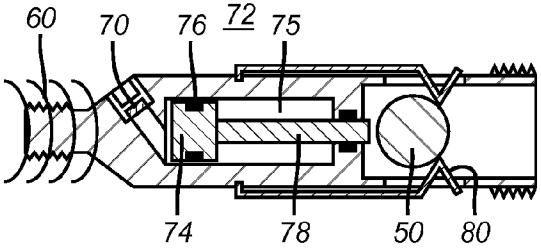
FIG. 16*a* shows the ball release tool just as the shock wave reaches it.
Figure 17A:
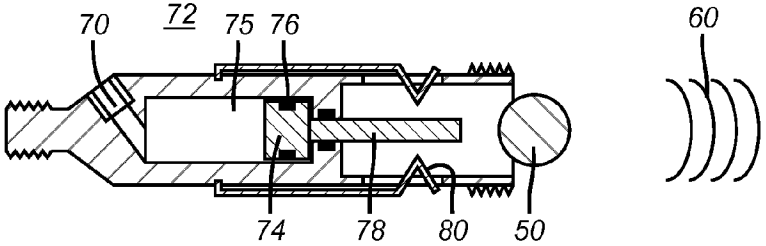
FIG. 17*a* shows a detail of the ball release tool in the ball released position.
Figure 20A:
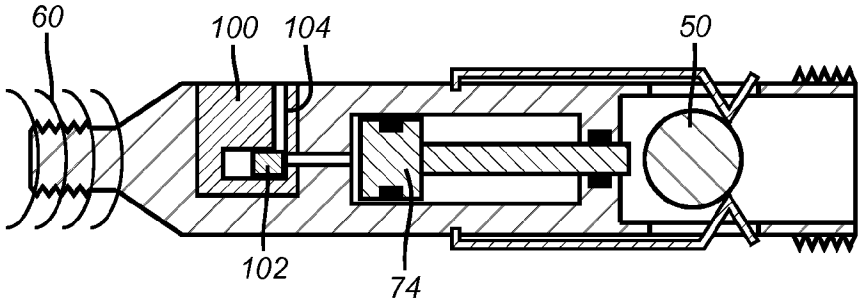
FIGS. 20*a*-20*b* are an alternative embodiment to the ball release tool that responds to a pressure spike by moving other parts from a breakable barrier to drive the ball from the ball release tool.
Figure 20B:
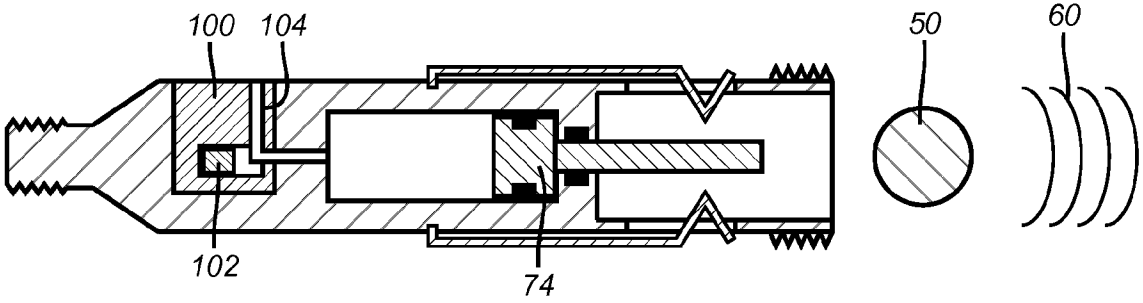

Referring to FIG. 15*a* a direct responding release tool 46 is shown. Direct means the pressure wave 60 has enough force to break a breakable member 70 such that well pressure in the surrounding annulus 72 can be brought to bear on the piston 74 that has a surrounding seal 76 so that an upper sealed variable volume chamber is defined and grows in volume as pressure from annulus 72 displaces the piston 74 and its associated push rod 78 to contact the ball 50 and push it past a retainer 80. Piston 74 pushes against variable volume chamber 75 that is initially at atmospheric pressure. When barrier 70 breaks there is a pressure differential on the piston 74 that is enhanced by the low pressure in chamber 75. FIG. 16*a* shows the shock wave 60 arriving at the breakable member 70 and breaking through and FIG. 17*a* shows the resulting movement of all the parts that will launch the ball 50 in the manner described above. Those skilled in the art will appreciate that FIGS. 15*a*-17*a* are schematic and intend to portray both direct and indirect actuation using the developed pressure from the discharge of the guns. In an indirect system, the generated pressure from shooting off the guns is sensed with a sensor that is powered with a stored energy source such as a battery to then take action to get parts moving to eject the ball 50. This can be accomplished by forcibly breaking the breakable member 70 or actuating a motor that moves piston 74 or in other ways getting part movement sufficient to expel the ball 50 so that it lands on the passage 52 of the frack plug 48 to allow subsequent pressure buildup for fracking represented by arrows 64. FIGS. 20*a*-20*b* generically illustrates an indirect system which processes the existence of the pressure wave to either harness it for part movement or to trigger part movement in other ways that release the ball. Thus an indirect system can still employ wellbore hydrostatic but the opening of access to the hydrostatic pressure is done with a sensed pressure signal that opens access to annulus pressure. In FIG. 20*a* instead of barrier 70 there is a pressure sensing module 100 to sense the presence of the pressure wave 60 and use that signal to operate a valve 102 that opens passage 104 to drive the piston 74 in the manner previously described. Alternatively, such a sensed pressure can provide power to a motor from a stored power supply that moves a mechanical element that expels the ball 50.

The above description is illustrative of the preferred embodiment and many modifications may be made by those skilled in the art without departing from the invention whose scope is to be determined from the literal and equivalent scope of the claims below:

We claim:

1. A method of delivery of an object from an object release tool located between at least one perforating gun and a frack plug set at a subterranean location with a frack plug setting tool to close a passage therethrough, comprising:

setting the frack plug with the setting tool;

releasing from said frack plug and commanding the firing of said gun;

releasing the object axially from an end of said release tool, such that said object avoids an annular space surrounding said release tool, automatically only if said gun fires.

2. The method of claim 1, comprising:

positioning the object release tool between said setting tool and said frack plug.

3. The method of claim 1, comprising:

sizing the passage in the frack plug to be larger than a clearance in an annular space around said gun.

4. The method of claim 1, comprising:

positioning the object release tool against said frack plug.

5. The method of claim 1, comprising:

retrieving said object and the object release tool with said gun if said gun misfires.

6. The method of claim 5, comprising:

delivering a replacement gun with said object release tool after said misfire with aid of flow from a surface location through said passage in said frack plug that has remained open due to object retention from said gun misfire.

7. The method of claim 1, comprising:

using a pressure wave from said gun firing to release said object.

8. The method of claim 7, comprising:

overcoming a retainer for said object by selectively introducing pressure from said pressure wave at a subterranean location to an actuating assembly in said release tool.

9. The method of claim 8, comprising:

breaking a barrier with said pressure wave to allow pressure at a subterranean location to move a piston of said actuation assembly against an atmospheric chamber in said release tool.

10. The method of claim 7, comprising:

sensing the pressure from said pressure wave and using said sensing to launch said object.

11. The method of claim 1, comprising:

providing a seat around said passage through said frack plug;

blocking said passage by landing said object on said seat.

12. The method of claim 11, comprising:

removing all but said frack plug of the bottom hole assembly after said gun actually fires;

pumping pressurized fluid into perforations made by said gun while forcing said object against said seat.

13. The method of claim 1, comprising:

using a ball, dart or wiper plug as said object.

14. The method of claim 1, comprising:

overcoming at least one retaining spring to release said object.

15. The method of claim 14, comprising:

pushing the object to displace said retaining spring using an actuation assembly that is moved against the object.

16. The method of claim 15, comprising:

moving the object with a pressure wave created by firing the gun.

17. The method of claim 16, comprising:

breaking a barrier with said pressure wave to provide pressure access to a piston that moves said object.

18. The method of claim 15, comprising:

sensing pressure from a pressure wave created by firing the gun;

using said sensed pressure to move said actuation assembly.

* * * * *